United States Patent [19]

Bryceland

[11] 4,032,731

[45] June 28, 1977

[54] PUSH-PULL SWITCH FOR USE IN AN ELECTRONIC WATCH

[75] Inventor: Maurice Cyril Bryceland, Dover, N.J.

[73] Assignee: Waldman Corporation, Parsippany, N.J.

[22] Filed: Jan. 20, 1976

[21] Appl. No.: 650,716

[52] U.S. Cl. ..... 200/16 B; 200/153 K; 200/159 R; 200/165

[51] Int. Cl.[2] ..... H01H 15/24; H01H 13/52

[58] Field of Search ..... 200/16 A, 16 B, 16 E, 200/133 K, 159 R, 161, 162, 163, 165, 275, 303

[56] References Cited

UNITED STATES PATENTS

| | | | |
|---|---|---|---|
| 1,679,846 | 8/1928 | Warner | 200/163 |
| 1,807,398 | 5/1931 | Fleek | 200/16 |
| 1,833,948 | 12/1931 | Lansing | 200/16 |
| 1,910,645 | 5/1933 | Soreng | 200/16 |
| 2,441,888 | 5/1948 | Lansing | 200/16 |
| 2,748,204 | 5/1956 | Woods et al. | 200/4 |
| 3,119,915 | 1/1964 | Stites | 200/153 K X |
| 3,258,548 | 6/1966 | Cartier et al. | 200/16 A |
| 3,488,464 | 1/1970 | Hocking | 200/82 |
| 3,678,235 | 7/1972 | Anderson | 200/303 X |
| 3,703,621 | 11/1972 | Viola et al. | 200/163 |
| 3,800,112 | 3/1974 | DuRocher | 200/161 |

*Primary Examiner*—James R. Scott
*Attorney, Agent, or Firm*—Shapiro and Shapiro

[57] ABSTRACT

A push-pull switch employs a coil spring contained in an internal chamber in a housing and surrounding a reduced central portion on a stem passing through the chamber. The spring is interposed between a pair of washers slidably receiving the central portion of the stem for urging the washers apart and into engagement with the opposite ends of the chamber. Each washer abuts a shoulder on the stem where the reduced portion thereof joins the remainder of the stem so that axial movement of the stem in either direction sufficient to bridge either of two pairs of contacts, imparts displacement to one or the other of the washers and hence to the spring. The stem is biased by a single spring into a central position at which both pairs of contacts are open.

8 Claims, 3 Drawing Figures

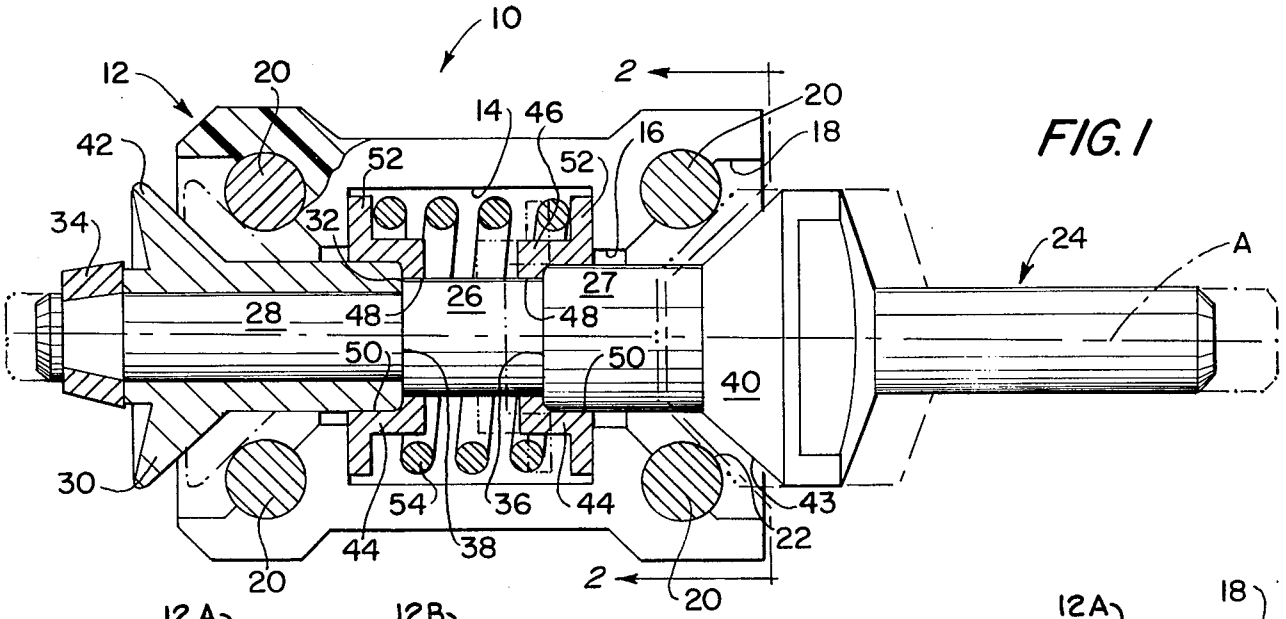
FIG. 1
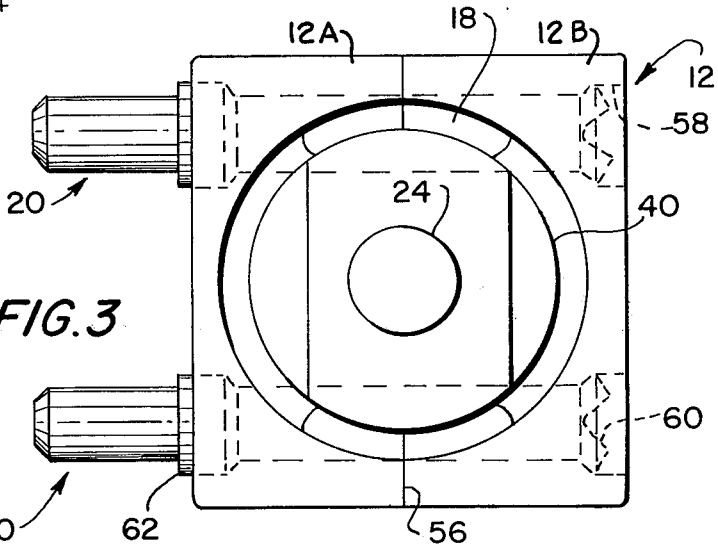
FIG. 2
FIG. 3

PUSH-PULL SWITCH FOR USE IN AN ELECTRONIC WATCH

BACKGROUND OF THE INVENTION

This invention relates to a push-pull switch for use in an electonic watch, and is more particularly directed to a switch of the type having an axially movable stem biased into a central position at which both of two sets of contacts of the switch are open, such switch being referred to hereinafter as a switch of the type described.

In a switch of the type described, wherein both sets of contacts are normally open, movement of the stem in one axial direction away from a central position to a first terminal position allows the stem to bridge one set of contacts, while movement in the opposite direction to a second terminal position allows the stem to bridge another set of contacts. Upon release of the stem when it is in either terminal position, a spring-bias returns the stem to its central or neutral position. A conventional switch of the type described achieves this result by employing a pair of springs, alternatively effective to resiliently resist axial movement of the stem in either direction away from its central positon. In this type of switch, the two springs are arranged serially along the axis of the stem, only one or the other being effective at any one time. This arrangement requires a relatively long package to contain the switch, a factor that makes it difficult to utilize a switch of this type in an electronic watch where size is of critical importance.

In another type of conventional switch of the type described, a double-sided conical cam mounted on the stem is engaged by a spring- loaded cam follower mounted for displacement in a direction prependicular to the axis of the stem. Displacement of the stem in either direction causes the cam to compress the spring so that upon release of the stem, the cam follower exerts an axial force on the stem returning the same to its neutral position. One spring is used in this switch, but it extends radially from the axis of the stem causing the package to be irregularly shaped and unsuitable for use in an electronic watch.

It is therefore an object of the present invention to provide a new and improved switch of the type described in which a single spring is used for the purpose of biasing the spring to its central position, but the switch package is nevertheless small and compact as compared to the prior art devices.

SUMMARY OF THE INVENTION

In accordance with the present invenion, a push-pull switch is provided in which a coil spring is contained in an internal chamber in a housing and surrounds a central portion of reduced diameter on a stem passing through the chamber, the spring being interposed between a pair of washers slidably receiving the central portion of the stem for urging the washers apart and into engagement with the opposite ends of the chamber. Each washer abuts a shoulder on the stem where the reduced portion thereof joins the remainder of the stem so that axial movement of the stem in either direction sufficient to bridge either of two pairs of contacts, imparts displacement to one or the other of the washers and hence to the spring. Thus, the stem is biased by a single spring into a central position at which both pairs of contacts are open. As a result, the switch of the present invention is extremely simple and can be incorporated into a small and compact package well adapted for use in an electronic watch.

BRIEF DESCRIPTION OF THE DRAWINGS

An embodiment of the pressent invention is disclosed in the accompanying drawings wherein:

FIG. 1 is a top view of a switch according to the present invention with the top half of the split switch housing removed;

FIG. 2 is a section taken along the 2—2 if FIG. 1, this view including both halves of the housing; and FIG. 3 is an end view of the switch of FIG. 1.

DESCRIPTION OF THE PREFERRED EMBODIMENT

Referring now to FIG. 1, reference number 10 designates a push-pull switch according to the present invention having a housing 12 made of electrically insulating material and containing an enlarged internal chamber 14 that connects to an axial bore 16 passing through the housing from one axial end to the other. Each axial end of the housing is provided with a conically shaped depression 18, the apex of which lies on the central axis A of the bore 16.

Metallic contact means are provided at each axial end of the housing in the form of a pair of contact pins 20 extending through the housing in a direction perpendicular to axis A, each pin having an exposed portion 22 projecting beyond depression 18 as indicated in FIG. 2 of the drawings.

Disposed in bore 16 is stem 24 having a central portion 26 of reduced diameter located between enlarged portion 27 and a further reduced portion 28 carrying a contact element 30 which is captured between shoulder 32 joining portions 26 and 28, and a collar 34 swaged to the axial end of the stem as shown in FIG. 1. The junction between portions 26 and 27 defines a shoulder 36, while the internal end of element 30 abutting shoulder 32 defines shoulder 38 which faces shoulder 36.

Stem 24 carries metallic contact means provided by the members 30 and 40 having enlarged conical conducting heads 42 and 43, respectively. When stem 24 is displaced leftwardly as shown in FIG. 1 to the position indicated by the chain lines having a dash and two dots, and member 40 engages portions 22 of contacts (located on the right side of housing 12 as viewed in FIG. 1), the stem will be in a first terminal position bridging these contacts. In this terminal position, member 30 is spaced from the contacts 20 located on the opposite end of the housing. When stem 24 is displaced rightwardly as seen in FIG. 1 to the position indicated by the chain lines having a dash and a single dot, and member 30 engages portion 22 of contacts 20 located on the left side of the housing, the stem will be in a second terminal position bridging the last mentioned contacts. In this terminal position, member 40 on the stem will be spaced from the other pair of contacts.

When stem 24 is in a central position intermediate its two terminal positions as shown in FIG. 1 by the full lines, members 30 and 40 are spaced from the two sets of contacts 20. The stem is releasably held in its central position by means that includes a single spring resiliently deflected upon axial displacement of the stem from its central position, the spring serving to bias the stem into its central position as described below.

Contained within chamber 14 are two washers 44 each having a central hub 46 containing an aperture 48 of a size to slidably receive central portion 26 of the stem, and a counter bore 50 of a diameter large enough to receive the portion 27 of the stem or the free end of element 30, both of which are of the same diameter. In addition, each washer 44 carries a flange 52 which abuts one of the opposite sides of internal chamber 14 as seen in FIG. 1. Finally, coaxial coil spring 54 is interposed between the washers 44 bearing against the flanges 52 and urging the washers apart and into engagement with the opposite sides of chamber 14.

In the preferred embodiment, the shoulders 36 and 38 on the stem are seated in counterbores 50 of the washers when the flanges 52 of the washers engage opposite sides of chamber 14.

Bore 16 is somewhat enlarged with respect to the diameters of portion 27 and the inner end of element 30, so that some lateral movement of the stem is possible, but the stem 24 is held against free lateral displacement by reason of the friction developed between flanges 52 of the washers and the opposite surfaces of chamber 14 as a consequence of the compression of spring 54. The spring also maintains the stem in its central axial position. When the stem is displaced axially leftwardly to its first terminal position as shown in FIG. 1, shoulder 36 causes leftward displacement of right-hand washer 44 compressing spring 54. Bore 48 in left-hand washer 44 serves as a bearing for portion 26 of the stem and substantially maintains the coaxial position of the stem in the housing. Upon release of the stem, the spring is effective to return the stem to its central position. Rightward axial displacement of the stem from its central position causes shoulder 38 to displace let-hand washer 44 and compress the spring. In this case, bore 48 in right-hand washer 44 serves as a bearing for portion 26 of the stem, substantially maintaining it coaxially in the housing. Release of the stem will allow the spring to return the stem to its central position.

In order to effect assembly of the various components of the present system, it is preferred that the housing 12 be made in two halves 12A and 12B symmetrical about the plane 56 (FIG. 2) containing the axis A and passing perpendicular to the axes of the pins 20. In assembling the switch of the present invention, the two washers and the spring are assembled on the stem before element 30 is placed over portion 28. After the washers, properly oriented and with the spring interposed, are assembled on portion 26 of the stem, element 30 can be fitted over portion 28 and fixed in place by swaging collar 34 onto the free end of the stem. The subassembly so formed can be fitted into one of the halves of the housing before the contact pins are inserted. This allows the halves of the housing to be closed capturing the washers and spring in chamber 14. The assembly is completed by inserting pins 20 into suitably aligned apertures in the housing, which apertures have counterbores 58 at each free end for allowing the free end of each contact 20 to be headed over as indicated by reference numeral 60 in FIG. 3 suchs that collar 62 on the opposite end of a pin seats in a counterbore in the housing.

The switch according to the present invention can be made very small by reason of the simplicity of the design providing a compact package ideally suited for incorporation into an electronic watch.

It is believed that the advantages and improved results furnished by the push-pull switch of the invention will be apparent from the foregoing description of several preferred embodiments of the invention. Various changes and modifications may be made without departing from the spirit and scope of the invention as sought to be defined in the following claims.

I claim:

1. A push-pull switch comprising a. a housing having an axial bore and an internal chamber connected to the bore;

b. metallic contact means at each axial end of the housing;

c. a stem axially displaceable in the bore between first and second terminal positions and having a pair of spaced shoulders defining a central stem portion of reduced diameter;

d. a pair of spaced metallic contact means on the stem for respectively engaging the cosntact means at one end of the housing or the other depending upon whether the stem is in its first or second terminal position; and e. means including a pair of washers in said chamber and a single spring resiliently deflectable upon axial displacement of the stem from a central position at which the contact means of the stem are spaced from the contact means of the housing, the spring serving to bias the stem into said central position, each washer having an aperture that slidably receives the reduced portion of the stem, the single spring being interposed between the washers for urging them apart and into engagement with opposite sides of the chamber, the shoulders on the stem being respectively engaged with the washers when the latter respectively engage the opposite sides of the chamber.

2. A push-pull switch according to claim 1, wherein the spring is a coil spring and surrounds the central portion of the stem.

3. A push-pull switch according to claim 1, wherein the bore in the housing is larger than the stem, so that some lateral movement of the stem is possible, but wherein the stem is held against free lateral displacement in the bore by the friction developed between each washer and the associated side of the chamber.

4. A push-pull switch according to claim 1, wherein the contact means on each end of the housing are in the form of a pair of pins located on opposite ends of the bore, and the contact means on each end of the stem is an enlarged head that bridges the pins when the stem is moved to a terminal position.

5. A push-pull switch according to claim 4, wherein the housing is in two halves separable along a plane that contains the axis of the stem and that is perpendicular to the pins.

6. A push-pull switch according to claim 5, wherein the halves of the housing are held together by pins.

7. A push-pull switch according to claim 4, wherein the enlarged head on each end of the stem is conical in shape.

8. A push-pull switch comprising a. a housing having an axial bore and an internal chamber connected to the bore.

b. metallic contact means at each axial end of the housing, said contact means including pairs of pins located at opposite ends of the bore, respectively;

c. a stem axially displaceable in the bore between first and second terminal positions;

d. a pair of spaced metallic contact means on the stem, each comprising an enlarged head for engaging and bridging the pins at one end of the housing or the other when the stem is moved to its first or second terminal position, respectively; and e. means including a single spring resiliently deflectable upon axial displacement of the stem from a central position at which the contact means of the stem are spaced from the contact means of the housing, the spring serving to bias the stem into said central position;

the housing comprising two halves separable along a plane that contains the axis of the stem and that is perpendicular to the pins, the halves of the housing being held together by the pins.

* * * * *